US007475534B2

(12) United States Patent
Pott et al.

(10) Patent No.: US 7,475,534 B2
(45) Date of Patent: Jan. 13, 2009

(54) METHOD FOR CONTROLLING FUEL INJECTION AND A MOTOR VEHICLE

(75) Inventors: Ekkehard Pott, Gifhorn (DE); Matthias Holz, Lehre (DE); Michael Zillmer, Sickte (DE); David Prochazka, Libosovice (CZ)

(73) Assignees: Volkswagen Aktiengesellschaft, Wolfsburg (DE); Skoda Auto a.s., Mlada Boleslav (CZ)

( * ) Notice: Subject to any disclaimer, the term of this patent is extended or adjusted under 35 U.S.C. 154(b) by 0 days.

(21) Appl. No.: 11/300,883

(22) Filed: Dec. 15, 2005

(65) Prior Publication Data

US 2006/0162324 A1 Jul. 27, 2006

(30) Foreign Application Priority Data

Jan. 24, 2005 (DE) ..... 10 2005 003 880

(51) Int. Cl.
*F01N 3/00* (2006.01)

(52) U.S. Cl. ..... 60/284; 60/274; 60/280; 60/285; 123/300; 123/305; 123/457; 123/179.3; 123/179.17

(58) Field of Classification Search ..... 60/274, 60/284, 285, 286, 280, 299; 123/299, 300, 123/304, 305, 431, 472, 457, 491, 179.3, 123/179.16, 179.17, 179.19, 179.28; 180/65.1, 180/65.2

See application file for complete search history.

(56) References Cited

U.S. PATENT DOCUMENTS 6,058,912 A * 5/2000 Rembold et al. ..... 123/516
6,145,490 A * 11/2000 Heidenfelder et al. ..... 123/295
6,301,529 B1 * 10/2001 Itoyama et al. ..... 701/22
6,439,190 B1 * 8/2002 Bochum ..... 123/295
6,659,069 B2 * 12/2003 Shiraishi et al. ..... 123/298
6,708,661 B1 * 3/2004 Aubourg et al. ..... 123/179.16
6,786,201 B2 * 9/2004 Ohtani ..... 123/431
7,082,930 B2 * 8/2006 Liller et al. ..... 123/491
7,136,727 B2 * 11/2006 Seo et al. ..... 701/22

* cited by examiner

*Primary Examiner*—Binh Q. Tran
(74) *Attorney, Agent, or Firm*—Norris, McLaughlin & Marcus

(57) ABSTRACT

The invention is directed to a method for controlling fuel injection in an internal combustion engine (10) having at least one electric machine (26), wherein a direct injection system (18) for direct injection of fuel into at least one combustion chamber (54) of the internal combustion engine (10) is associated with the internal combustion engine (10), the direct injection system (18) including a mechanically driven high-pressure fuel pump (22) for generating a fuel pressure in an accumulator volume (20) upstream of the at least one combustion chamber (54).

It is provided that during a startup process of the internal combustion engine (10) fuel is injected by at least one of the following measures:

(a) activation of the fuel injection into the at least one combustion chamber (54) only after a minimum fuel pressure is reached, and (b) monitoring a course of a run-up of the internal combustion engine (10) after fuel injection has begun and, if a deviation of the course from a desired course is detected, at least partial compensation of the deviation by a motor intervention of the at least one electric machine (26).

The startup process can be performed so as to result in considerable fuel savings and low emissions.

32 Claims, 2 Drawing Sheets

METHOD FOR CONTROLLING FUEL INJECTION AND A MOTOR VEHICLE

FIEID OF THE INVENTION

The invention relates to a method for controlling fuel injection in a startup phase of a direct-injection internal combustion engine having at least one electric engine which also operates as a starter generator, and to a motor vehicle capable of performing the method.

BACKGROUND

In direct-injection spark-ignition engines (Otto engines) and common rail diesel engines, fuel is typically injected directly into the combustion chamber of the cylinders by electronically controlled injection valves. The fuel is typically supplied by an electric feed pump from the fuel tank and stored at high-pressure in an accumulator volume upstream of the injection valves (injectors). The pressure in the accumulator volume is generated by a high-pressure fuel pump which is mechanically driven by the internal combustion engine, in particular by the camshaft or crankshaft. In spark-ignition engines, the typical fuel pressure in idle mode is approximately 60 bar and during normal operation approximately 120 bar. Conversely, diesel engines have operating pressures of at least approximately 300 bars in idle mode, and of maximally approximately 1800 bar in normal driving mode. With this type of injection, an injection pressure can be generated independent of the motor RPM and the injected fuel quantity.

The typical startup operation of internal combustion engines is performed by conventional, battery-operated starter motors, which are activated by turning an ignition key and the like and transfer a torque to the crankshaft of the internal combustion engine. At the same time, fuel injection is activated. As soon as the internal combustion engine reaches a ceiling RPM, from which the engine can run-up on its own (for spark-ignition engines approximately 60 . . . 100 $min^{-1}$, for diesel engines approximately 80 . . . 200 $min^{-1}$), the starter motor is disengaged from the crankshaft and the internal combustion engine continues to run up to its engine-dependent idle RPM. This method has the disadvantage that the injection pressure in direct-injection internal combustion engines is relatively low during the first injection events, because the high-pressure fuel pump is driven mechanically, generally only slightly above the pressure of the feed pump of approximately 4 to 7 bar. This adversely affects the quality of the fuel jet and the combustion and hence also the exhaust gas emission (in particular when the catalytic converter system has not yet reached its operating temperature). For example, at injection pressures below approximately 10 bar, a narrow jet is formed on the injectors instead of the desired finely dispersed spray cone. Incomplete processing of the mixture in the combustion chamber during startup operation is conventionally at least partially compensated by increasing the injected fuel quantity, which results in increased emissions.

Another problem during the startup phase of the direct-injection spark-ignition engine or diesel engine is partial condensation of the injected fuel on the cylinder walls and the piston head while these are still cold. The wall film evaporates and only partially combusts, while the rest is exhausted in the form of HC emissions. In order to compensate for the undesirable "starving" (becoming lean) due to the formation of the wall film and to produce a combustible mixture, a larger fuel quantity is usually injected than required after the engine has warmed up. This fuel enrichment in the startup phase or after the startup phase also causes increased emissions.

Also known are hybrid drives for motor vehicles which include an (for example, direct injection) internal combustion engine and in addition at least one electric machine which can be selectively switched to a motor mode or a generator mode. With serial hybrid concepts, the vehicle is driven exclusively by the electric machine, while the internal combustion engine generates via a separate generator electric current for charging an energy storage device that supplies the electric machine or for directly supplying current to the electric machine. Conversely, parallel hybrid concepts are at present frequently used at least in passenger vehicle applications, wherein the vehicle can be driven by the internal combustion engine or the electric machine, or both. In parallel concepts, the electric machine is typically connected in motor mode to support the internal combustion engine while operating at higher vehicle loads. The electric machine can also operate as a starter motor ("starter generator") for the internal combustion engine. However, the electric machine is predominantly operated as a generator while the vehicle is powered by the internal combustion engine, whereby the generated electric energy is used to charge the energy storage device and/or to supply energy to an onboard electric system. In addition, at least a portion of the braking power is supplied by the electric machine in generator mode (energy recovery) by converting a portion of the dissipated mechanical energy into electric energy. The internal combustion engine of a hybrid drive is typically equipped with a start-stop automatic, which controllably turns the internal combustion engine off and restarts the internal combustion engine under certain conditions. Frequent startup of the direct-injection internal combustion engine in hybrid drives only aggravates the aforedescribed problems.

In summary, the startup phase of direct-injection internal combustion engines consumes a relatively large quantity of fuel and increases emissions, which due to its rate of recurrence has adverse effects particularly in hybrid drives.

SUMMARY OF THE INVENTION

It is an object of the present invention to provide a method for starting a direct-injection internal combustion engine, which compared to conventional concepts is optimized with respect to fuel consumption and pollutant emission. The method should also be suitable for application in a motor vehicle with a hybrid drive.

According to a first aspect of the invention, fuel injection is activated during a startup phase of the internal combustion engine (10) only after a minimum fuel pressure is reached. In other words, after the electric machine which operates as a starter generator, is turned on, fuel injection is not enabled immediately, but only after the minimal fuel pressure has built up in one of the combustion chambers, in particular in the accumulator volume upstream of the injectors. A sufficiently high injection pressure, which ensures adequate mixture preparation in the combustion chamber and prevents fuel condensation in the form of wall films on the cylinder walls and the piston head, is already provided during the initial injection phase. The invention hereby takes advantage of the properties of electric machines and starter generators which can quickly reach a high rotation speed and provide a large torque compared to conventional starter motors. The high-pressure fuel pump of the injection system is hence quickly activated, which leads to a comparatively rapid pressure buildup in the accumulator volume (rail).

In an advantageous embodiment of the method, in particular in a spark-ignition internal combustion engine, a predetermined minimal fuel pressure is at least 20 bar, in particular at least 30 bar. A particular good mixture preparation can be obtained with a fuel pressure of at least 40 bar before injection is enabled. In a self-ignition internal combustion engine (common rail diesel engines), the predetermined minimal fuel pressure can be at least 150 bar, in particular at least 300 bar, preferably at least 400 bar.

According to a particularly advantageous embodiment of the invention, at least a minimum rotation speed (RPM) of the internal combustion engine is required before fuel injection is applied. In this way, the self-powered run-up phase of the internal combustion engine which causes high emissions can be further minimized. The minimum RPM can then be set to correspond to at least 50% of an engine-specific idle RPM, in particular to at least 70%, preferably to at least 80%, and particularly preferred to at least 90% of the idle RPM.

Advantageously, a maximum injection pressure should be maintained in addition to the minimum fuel pressure, wherein the maximum injection pressure is at most 40 bar, in particular at most 30 bar, and preferably at most 20 bar above an engine-specific idle operating pressure (for example, 60 bar). Presetting the maximum pressure prevents fuel condensation on the cylinder walls and the piston head, in particular when the engine is still cold. Diesel engines may require a larger differential to the engine-specific idle operating pressure.

According to a second measure for reducing startup emissions according to the invention, a run-up course of the internal combustion engine is analyzed during a startup phase of the internal combustion engine at least after fuel injection has begun, and if a deviation of the run-up course from a desired course is detected, the deviation is at least partially compensated by a corresponding motor intervention of the at least one electric machine (or the starter generator). Such deviation is typically compensated in conventional processes by enriching the fuel mixture, i.e., by increasing the supplied fuel quantity, during or after startup, because the combustion mixture in the combustion chamber becomes leaner due to the wall film effects. Conversely, with the present invention, this compensation is performed at least primarily through intervention of the electric machine or the starter generator. Accordingly, this measure can reduce fuel consumption and exhaust emissions also during the startup phase. The rapid run-up time of the starter generator and its fast controllability can be advantageously employed.

Torque compensation can be optimized by monitoring the run-up phase of the internal combustion engine by measuring the RPM with high resolution. For example, in a four-stroke internal combustion engine with up to four cylinders, the run-up phase in idle mode can be easily monitored with a resolution of at least four operating cycles, in particular at least two operating cycles. Preferably, the run-up phase can be measured with an RPM resolution of only one operating cycle. Rapid control of the starter generator can be easily achieved.

The run-up phase of the internal combustion engine can be monitored based on suitable parameters. A particularly suitable parameter is the engine speed, whereby the RPM characteristic can be monitored with conventional rotation speed sensors normally disposed on the crankshaft. The reduced performance of the internal combustion engine during the startup phase can also be detected by other measures which measure, for example, the combustion characteristic. For example, the ion current of the spark plug can be measured in a spark-ignition engine.

Unlike in conventional approaches, where the mixture is typically enriched during or after the startup phase, the internal combustion engine is started according to the present invention entirely without fuel mixture enrichment at least at engine temperatures above 17° C., as compared to a fuel injection determined by the operating point, or the fuel mixture is enriched at least to a lesser degree than with conventional approaches. According to a preferred embodiment, the internal combustion engine is started at least at engine temperatures of above 5° C. without enriching the fuel injection, in particular at engine and/or coolant temperatures above −2° C., and most preferably at temperatures of at least above −10° C. Depending on the design of the internal combustion engine and the electrical machine (starter generator), fuel can be injected without mixture enrichment at arbitrary engine and/or coolant temperatures.

The two measures according to the invention, namely activation of the fuel injection after a minimum fuel pressure has been reached and compensation for a deviation of the engine run-up phase due to lean conditions by connecting at least one electric machine or the starter generator, supplement each other synergistically and are therefore preferably implemented together.

Another aspect of the invention relates to a motor vehicle which is characterized by means capable of performing fuel injection during a startup phase of the internal combustion engine by using the aforedescribed measures. These means include in addition to a logic control stored in a control unit for performing the required method steps also constructive measures, for example a pressure sensor in the accumulator volume of the injection system, rotation speed sensors and temperature sensors, as well as other features.

The electric machine implemented as a starter generator should be capable of operating without slippage, which can be achieved, in particular, by using a starter generator driven by the crankshaft. The invention can be advantageously employed in hybrid drive concepts, wherein the vehicle is preferably powered by a parallel arrangement of the internal combustion engine and the at least one electric machine.

Because the startup operation generates low emissions, a precious metal content of the catalytic converters of the exhaust system can be reduced compared to conventional systems, without exceeding permissible emission limits. Advantageously, an exhaust system with at least one catalytic converter having a total volume of at least 0.9 l per liter displacement of the internal combustion engine can have an average precious metal content of at most 3.59 g/dm$^3$ (100 g/ft$^3$), in particular at most 2.87 g/dm$^3$ (80 g/ft$^3$), preferably at most 2.15 g/dm$^3$ (60 g/ft$^3$). In spite of the relatively low precious metal content, an HC emission of maximally 0.01 g/mile and a $NO_x$ emission of maximally 0.02 g/mile can be maintained during the U.S. drive cycle FTP-75 covering a distance of 120,000 miles. In particular, according to the invention, a total precious metal weight for all catalytic converters is at most 3 g/l displacement of the internal combustion engine, in particular at most 2.5 g/l displacement, preferably at most 2 g/l displacement, and most preferably at most 1.5 g/l displacement.

Exemplary embodiments of the invention will be described hereinafter with reference to the drawings.

DETAILED DESCRIPTION OF THE INVENTION

Figure 1:
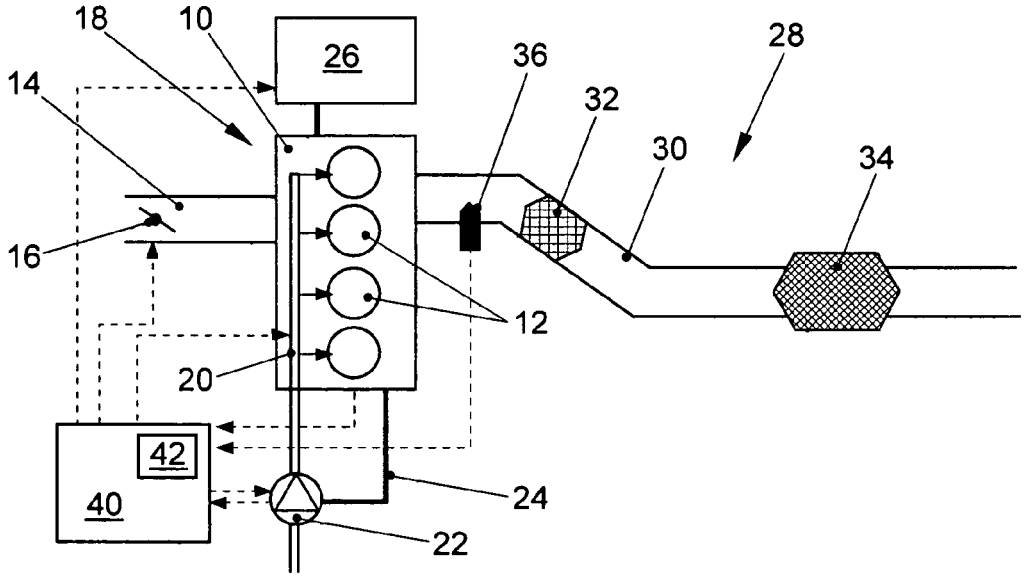
FIG. 1 shows schematically the configuration of an internal combustion engine according to the invention with a direct fuel injection system and a starter generator.

As shown in FIG. 1, the four-cycle internal combustion engine 10 capable of lean operation includes, for example, four cylinders 12. The internal combustion engine 10 can operate in a self-ignition mode (diesel engine) or can, as in the present example, operate by spark-ignition (Otto or gasoline engine). Air is supplied to the cylinders 12 through an intake manifold 14, whereby the air mass flow can be adjusted by a controllable throttle 16 as a function of the operating point. A direct injection system, shown with the reference symbol 18, is associated with the internal combustion engine 10 and injects fuel directly into the combustion chambers of cylinders 12 through fuel injection valves (injectors), which are not shown in FIG. 1. The fuel accumulates under high-pressure in a common accumulator volume 20, also referred to as a rail, which is located upstream of the injectors. The fuel pressure (rail pressure) in the accumulator volume 20 is produced by a high-pressure fuel pump 22 which is driven by a power train, schematically indicated with reference symbol 24, connected to the internal combustion engine 10, in particular to a camshaft or crankshaft of the internal combustion engine 10. The high-pressure fuel pump 22 is configured, for example, as a piston pump, in particular as a radial piston pump. Details of the construction of the direct injection system 18 will be described with reference to FIG. 2.

As further shown in FIG. 1, the internal combustion engine 10 is connected to the electric machine configured as a starter generator 26, which operates on or is driven by the crankshaft of the internal combustion engine in a conventional manner. The starter generator 26 can be connected to the engine crankshaft in various ways. For example, the starter generator 26 can be directly connected to the crankshaft or by way of a coupling or transmission, or by another non-positive and/or positively-locked connection. In any case, the starter generator 26 should operate with as little slippage as possible, so that a belt drive is not favored in this application. For example, the starter generator 26 can be an asynchronous machine or a permanently-excited synchronous machine. In particular, the starter generator 26 can be implemented as an integrated crankshaft starter generator arranged between the internal combustion engine 10 and a transmission (not shown). The primary task of the starter generator 26 is to start the internal combustion engine 10 after an engine stop. If the internal combustion engine 10 is also equipped with a start-stop automatic, which automatically turns the internal combustion engine 10 off when the vehicle stops (for example at a signal), then the starter generator 26 also restarts the internal combustion engine 10. The starter generator 26 can be selectively operated in motor mode or in generator mode and therefore also supplies energy during the operation of the internal combustion engine 10 to charge the battery of the vehicle or to directly supply power to onboard devices of the vehicle (neither is shown).

FIG. 1 also shows an exhaust system 28 which includes an exhaust line 30 with a catalytic converter system 32, 34. The catalytic converter system includes a catalytic pre-converter 32 arranged proximate to the engine and designed, for example, as a three-way catalytic converter that converts hydrocarbons HC, carbon monoxide CO, and nitric oxides $NO_x$. A large-volume main catalytic converters 34, which can be for example an $NO_x$ storage catalytic converter, is located remote from the engine. During lean operating phases, the storage catalytic converter stores nitric oxides, while desorbing and catalytically converting the nitric oxides during regeneration phases. The exhaust system 28 typically also includes various exhaust gas sensors and temperature sensors used to control the system. Of these sensors, only a lambda sensor 36 located upstream of the catalytic pre-converter 32 is shown which controls the air-fuel mixture of the internal combustion engine 10. Both catalytic converters 32, 34 of the catalytic converter system 32, 34 have a combined volume of at least 0.9 liter per liter engine displacement of the internal combustion engine 10, with an average precious metal content of at most 2.87 g/dm$^3$ (80 g/ft$^3$), ideally of at most 2.15 g/dm$^3$ (60 g/ft$^3$). Alternatively or in addition, the total precious metal weight (for the combination of both catalytic converters 32, 34) can have a design value of at most 2.0 g, ideally of at most 1.5 g per liter engine displacement. The precious metal content of the catalytic converter system 32, 34 can by very low compared to conventional systems due to the particularly low emissions during the startup process according to the invention. For example, with the aforedescribed design of the catalytic converters, an HC emission of maximally 0.01 g/mi and a $NO_x$ emission of maximally 0.02 g/mi can be guaranteed for the U.S. driving cycle FTP-75 over a traveled distance of 120,000 miles (mi), providing the vehicle is in good operating condition and the catalytic converters are undamaged. (In comparison: vehicles that achieve in the same U.S. driving cycle HC emissions of <0.007 g/mi and $NO_x$ emissions of <0.015 g/mi currently have an average precious metal content of ≧3.59 g/dm$^3$ (≧100 g/ft$^3$) for a total catalytic converter volume of the 0.9 liter/liter engine displacement).

Figure 2:
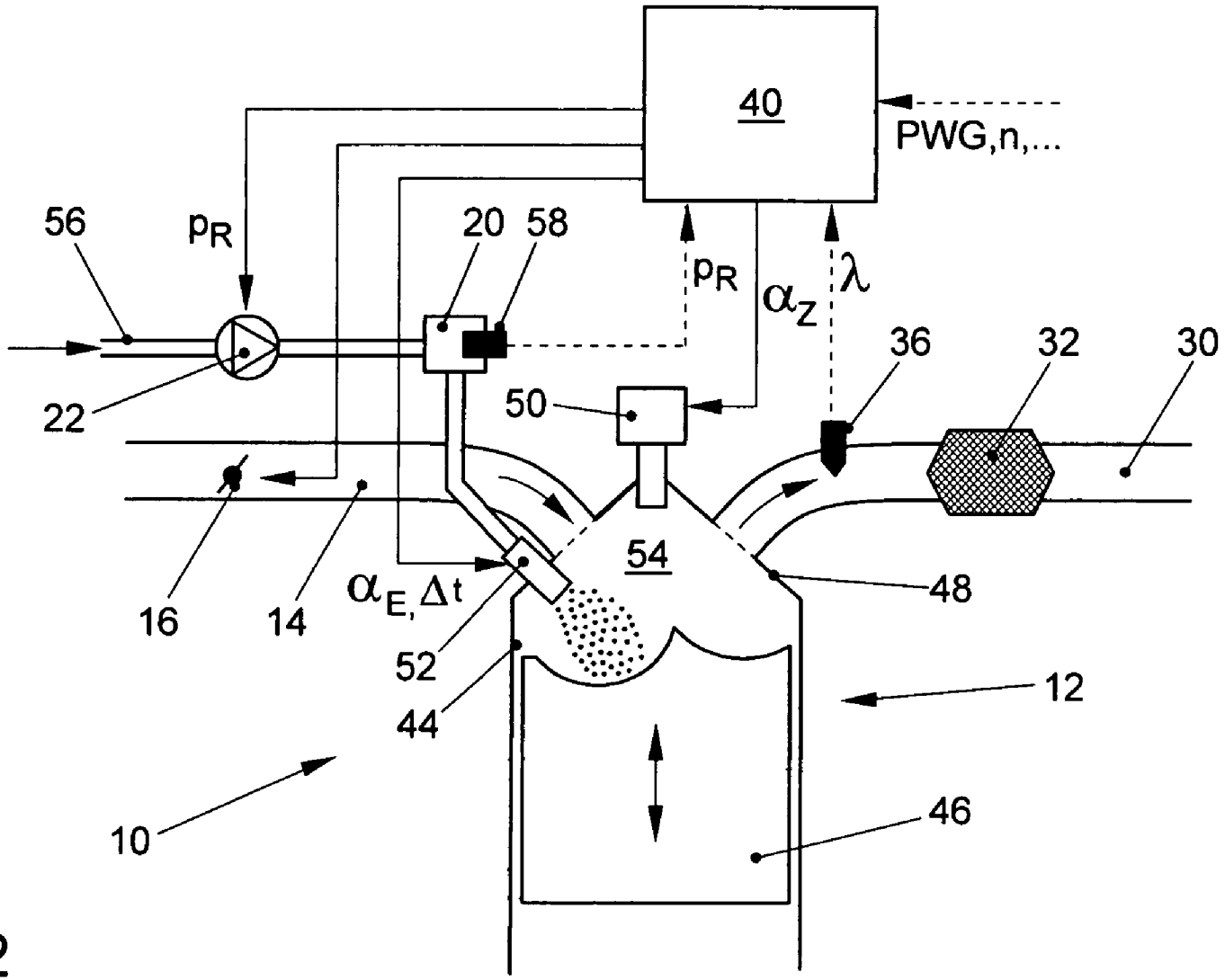
FIG. 2 shows schematically the configuration of a cylinder of the internal combustion engine of FIG. 1 and associated control elements.

FIG. 2 shows only one exemplary cylinder 12 of the internal combustion engine 10 of FIG. 1, whereby elements identical to those of FIG. 1 are indicated with the same reference numerals. A piston 46 movable in the axial direction is arranged in a cylinder housing 44 of cylinder 12. The piston head is designed with a recess for producing a stratified charge (when operating under partial load). A spark plug 50 with an ignition coil is located at a central upper location of a cylinder head 48 of the cylinder housing 14, and a high pressure injection valve (injector) 52 is located on one side, with the injector injecting fuel directly into a combustion chamber 54 of cylinder 12. The injector 52 receives fuel through a fuel line 56. The fuel is supplied from a fuel tank (not shown) by a fuel pump (also not shown) with an admission pressure of, for example, 4 bar and is compressed by the high-pressure fuel pump 22 to a fuel pressure which is between 40 bar (idle mode) and 120 bar for typical vehicle operating conditions. The fuel pressure is set according to an operating point of the internal combustion engine 10. The fuel pump 22 in cooperation with a pressure control valve (not shown) compensates pressure variations in the accumulator volume 20 located upstream of the injector 52. The fuel pressure $p_R$ in the accumulator volume 20 is measured with a pressure sensor 58, which can advantageously be arranged in the common distribution rail. The fuel pressure $p_R$ is controlled by the engine controller 40 (see below) via a closed control loop. For sake of clarity, FIG. 2 does not show intake and exhaust valves, which can be controlled electronically or via camshafts and which are arranged for movement in the terminations of the intake line 14 and the exhaust line 30, respectively, of cylinders 12.

FIGS. 1 and 2 also show an engine controller 40, which receives and processes various signals from the internal combustion engine 10 (rotation speed (RPM) n, engine and coolant temperature, etc.), the exhaust system 28 (lambda λ, exhaust gas temperature), the injection system 18 (fuel pressure PR) and the load request of the vehicle, as indicated by a pedal value transducer signal PWG, and other signals. The engine controller 40 determines from the input values the required actuator and control signals by accessing the characteristic curves and performance characteristics stored in the engine controller 40. The control signals are used to control various components, for example, the throttle 16, the starter generator 26, the injectors (injection angle $\alpha_E$, open duration $\Delta t$), the ignition (ignition angle $\alpha_Z$), and the fuel pump 22 (desired fuel pressure $p_s$). In particular, the engine controller includes logic control 42 (FIG. 1) for performing the following process for controlling fuel injection when the internal combustion engine 10 is started with the starter generator 26.

As soon as a driver of the motor vehicle sends a start signal to the engine controller 40 by turning an ignition key, the starter generator 26, which is powered by the energy storage device of the hybrid system (for example, a capacitive storage device and/or a high-performance battery) or by the vehicle battery begins to operate first. The rapid run-up phase of the starter generator 26 also starts operation of the mechanically driven fuel pump. The fuel pressure in the accumulator volume 20 is initially controlled to an engine-specific desired idle pressure of, for example, 60 bar (controlled variable). At the same time, the pressure sensor 58 continuously measures the fuel pressure $p_R$ in accumulator 20, while a rotation speed sensor (not shown) disposed on the engine crankshaft measures the engine rotation speed n. The logic control 42 implemented in the engine controller continuously compares the measured signals $p_R$ and n with corresponding limit values, with fuel injection enabled when the limit values are exceeded. More particularly, this occurs at a minimum fuel pressure of 40 bar and a minimum rotation speed of approximately 80% of an engine-specific idle rotation speed of the internal combustion engine 10. Preferably, fuel injection is enabled only after both limit values have been reached or exceeded, i.e., the injector 52 is controlled and opens in accordance with an injection angle $\alpha_E$ (control begin) set by the engine controller 40 and an injection duration $\Delta t$ proportional to the injected quantity. The spark plug 50 is also controlled in accordance with the ignition angle $\alpha_Z$. When operating within these limit values, a highly combustible mixture is already present in the combustion chambers 54 of cylinder 12 during the first injection events. In particular, the injected fuel forms a finely dispersed injection jet which minimizes the emission of pollutants in the exhaust gas. At the same time, the injection pressure is monitored during the startup operation to ensure that the injection pressure does not exceed the engine-specific idle pressure of, for example, 60 bar by more than 20 bar. If this limitation is exceeded, the system pressure is reduced (by opening the pressure control valve) and injection is disabled to prevent the injected fuel from condensing on the cylinder walls and the piston head, which are still at a temperature below the operating temperature.

Already during the first injection events following the startup, the injected fuel quantity is adjusted by controlling the open duration $\Delta t$ of the injector depending on the operating point according to the normal idle mode of the internal combustion engine 10. In other words, at least at an engine temperature above −10° C., preferably at all temperatures, there is no longer a need to enrich the fuel mixture during the startup phase or after the startup phase. Because wall film effects cannot be totally prevented even with a favorable initial mixture composition in the combustion chamber 54, the engine performance during the run-up phase of the internal combustion engine 12 is monitored according to the invention and compared with a desired characteristic no later than when fuel injection begins. The RPM curve in particular is indicative of the run-up characteristic. If a deviation is detected between the measured RPM curve and the desired curve, in particular if the RPM values are below the desired curve, then the starter generator 26 is activated to supply additional torque to the engine crankshaft so as to substantially compensate the detected deviation. In this way, a "rough engine operation in lean mode" indicative of rotation speed variations, which may occur when the mixture in the combustion chamber 54 unintentionally becomes too lean, can be prevented through intervention by the starter generator 26 alone, without enriching the fuel mixture.

According to an alternative embodiment of the system depicted in FIG. 1, the vehicle drive train can advantageously be implemented as a parallel hybrid drive, wherein the internal combustion engine 10 and the starter generator 26, which can selectively operate in motor mode or generator mode, can complement each other to form the vehicle drive train. The internal combustion engine 10 should be operated only over an operating range with a favorable efficiency, while the starter generator 26 operating as an electric motor (providing, for example, 10 to 25 kW power) can be used in other situations to supply additional power. Alternatively, all the drive power can be supplied by the starter generator 26. Under certain conditions, a start-stop automatic automatically shuts the internal combustion engine 10 down and restarts it again, whereby the restarts processes are also performed according to the method of the invention.

LIST OF REFERENCE SYMBOLS

10 internal combustion engine
12 cylinder
14 intake line
16 throttle
18 direct injection system
20 accumulator volume
22 high-pressure fuel pump
24 power train fuel pump
26 electric machine/starter generator
28 exhaust system
30 exhaust line
32 catalytic pre-converter
34 main catalytic converter
36 lambda sensor
40 engine controller
42 control logic
44 cylinder housing
46 piston
48 piston head
50 spark plug
52 fuel injection valve (injector)
56 fuel line
54 combustion chamber
58 pressure sensor
$\alpha_E$ injection angle (control begin)
$\Delta t$ injection duration (valve open)
$\alpha_Z$ ignition angle
n rotation speed (RPM)
$\lambda$ lambda
$p_R$ fuel pressure
PWG pedal transducer signal

The invention claimed is:

1. Method for controlling fuel injection in an internal combustion engine (10) having at least one electric machine (26), wherein a direct injection system (18) for direct injection of fuel into at least one combustion chamber (54) of the internal combustion engine (10) is associated with the internal combustion engine (10), with the direct injection system (18) including a mechanically driven fuel pump (22) for generating a fuel pressure in an accumulator volume (20) upstream of the at least one combustion chamber (54), the method comprising the steps of:

during a startup phase of the internal combustion engine (10), at least after fuel injection has begun, monitoring a run-up course of the internal combustion engine (10) by measuring engine rotation speed, and if a deviation of the run-up course between a desired course and the measured engine rotation speed is detected, at least substantially compensating for the deviation by performing a motor intervention with of the at least one electric machine (26) wherein the at least one electric machine (26) performs the motor intervention by supplying torque to a crankshaft of the internal combustion engine (10) to substantially compensate the detected deviation.

2. Method according to claim 1, wherein during the startup phase of the internal combustion engine (10), the fuel injection is activated only after a minimum fuel pressure is reached.

3. Method according to claim 2, wherein in a spark-ignition internal combustion engine (10), the minimum fuel pressure is at least 20 bar.

4. Method according to claim 2, wherein in a self-ignition internal combustion engine (10), the minimum fuel pressure is at least 150 bar.

5. Method according to claim 2, wherein the fuel injection is activated only after the internal combustion engine (10) has reached a minimum rotation speed (RPM).

6. Method according to claim 5, wherein the minimum RPM is at feast 50% of an idle RPM.

7. Method according to claim 2, wherein in a spark-ignition internal combustion engine (10), a maximum injection pressure of at most 40 bar above an idle operating pressure is maintained.

8. Method according to claim 1, wherein in a four-stroke internal combustion engine (10) with four or less cylinders (12), the run-up in idle mode is monitored with an RPM resolution of at least four operating cycles.

9. Method according to claim 1, wherein the fuel injection is implemented at least at engine temperatures >17° C. without cold-start enrichment, as compared to a fuel injection commensurate with the operating point.

10. Method according to claim 9, wherein the fuel injection without cold-start enrichment is implemented at least at one of engine and coolant temperatures of >5° C.

11. Motor vehicle with an internal combustion engine (10) having at least one electric machine (26), with a direct injection system (18) for direct injection of fuel into at least one combustion chamber (54) of the internal combustion engine (10) associated with the internal combustion engine (10), wherein the direct injection system (18) includes a mechanically driven fuel pump (22) for generating a fuel pressure in an accumulator volume (20) upstream of the at least one combustion chamber (54), the vehicle comprising:

means for injecting fuel during a start-up operation of the internal combustion engine (10) including:

means for monitoring a course of a run-up of the internal combustion engine (10) during a startup phase of the internal combustion engine at least after fuel injection has begun by measuring engine rotation speed;

means for detecting a deviation of the course between a desired course and the measured engine rotation speed; and means for at least substantially compensating for the deviation by performing a motor intervention with of the at least one electric machine (26) if the deviation is detected, wherein the motor intervention is performed by the at least one electric machine (26) supplying torque to a crankshaft of the internal combustion engine (10) to substantially compensate the detected deviation.

12. Motor vehicle according to claim 11, wherein the at least one electric machine (26) is implemented as a starter generator operating on the crankshaft of the internal combustion engine (10).

13. Motor vehicle according to claim 11, wherein the internal combustion engine (10) and the at least one electric machine (26) form a hybrid drive.

14. Motor vehicle according to claim 11. wherein the motor vehicle includes an exhaust system (28) having at least one catalytic converter (32, 34), wherein for a total volume of the catalytic converter of at least 0.9 l per liter engine displacement of the internal combustion engine (10), an average precious metal content of the at least one catalytic converter (32, 34) is at most 3.59 g/dm$^3$.

15. Motor vehicle according to claim 11, wherein the motor vehicle includes an exhaust system (28) having at least one catalytic converter (32, 34), wherein a total precious metal weight of the at least one catalytic converter (32, 34) is at most 3 g per liter displacement of the internal combustion engine (10).

16. Method according to claim 3, wherein in the spark-ignition internal combustion engine (10), the minimum fuel pressure is at least 30 bar.

17. Method according to claim 3, wherein in the spark-ignition internal combustion engine (10), the minimum fuel pressure is at least 40 bar.

18. Method according to claim 4, wherein in the self-ignition internal combustion engine (10), the minimum fuel pressure is at least 300 bar.

19. Method according to claim 4, wherein in the self-ignition internal combustion engine (10), the minimum fuel pressure is at least 400 bar.

20. Method according to claim 6, wherein the minimum RPM is at least 70% of the idle RPM.

21. Method according to claim 6, wherein the minimum RPM is at least 80% of the idle RPM.

22. Method according to claim 7, wherein in the spark-ignition internal combustion engine (10), the maximum injection pressure of at most 30 bar above the idle operating pressure is maintained.

23. Method according to claim 7, wherein in the spark-ignition internal combustion engine (10), the maximum injection pressure of at most 20 bar above the idle operating pressure is maintained.

24. Method according to claim 8, wherein the run-up in the idle mode is monitored with the RPM resolution of at least two operating cycles.

25. Method according to claim 8, wherein the run-up in the idle mode is monitored with the RPM resolution of at least one operating cycle.

26. Method according to claim 10, wherein the fuel injection without cold-start enrichment is implemented at least at one of engine and coolant temperatures of >−2° C.

27. Method according to claim 10, wherein the fuel injection without cold-start enrichment is implemented at least at one of engine and coolant temperatures of >−10° C.

28. Motor vehicle according to claim 11, wherein the means for injecting fuel during the start-up operation of the internal combustion engine (10) includes activation of the fuel injection into the at least one combustion chamber (54) only after a minimum fuel pressure is reached.

29. Motor vehicle according to claim 14, wherein the average precious metal content of the at least one catalytic converter (32, 34) is at most 2.87 g/dm$^3$.

30. Motor vehicle according to claim 14, wherein the average precious metal content of the at least one catalytic converter (32, 34) is at most 2.15 g/dm$^3$.

31. Motor vehicle according to claim 15, wherein the total precious metal weight of the at least one catalytic converter (32, 34) is at most 2 g per liter displacement of the internal combustion engine (10).

32. Motor vehicle according to claim 15, wherein the total precious metal weight of the at least one catalytic converter (32, 34) is at most 1.5 g per liter displacement of the internal combustion engine (10).

* * * * *